United States Patent [19]

Tremblay

[11] Patent Number: 4,722,775

[45] Date of Patent: Feb. 2, 1988

[54] APPARATUS AND METHOD FOR CONTROLLING ANODE MOVEMENT IN ALUMINIUM REDUCTION CELLS

[75] Inventor: Jean-Pierre L. Tremblay, Arvida, Canada

[73] Assignee: Alcan International Limited, Montreal, Canada

[21] Appl. No.: 896,462

[22] Filed: Aug. 13, 1986

[30] Foreign Application Priority Data

Aug. 23, 1985 [GB] United Kingdom ..... 8521128

[51] Int. Cl.[4] ..... C25C 3/20; C25D 17/00

[52] U.S. Cl. ..... 204/225; 204/228; 204/245

[58] Field of Search ..... 204/225, 243 R–247, 204/67, 228

[56] References Cited

U.S. PATENT DOCUMENTS

| | | | |
|---|---|---|---|
| 2,731,412 | 1/1956 | Ferrand | 204/225 X |
| 3,329,592 | 7/1967 | Uhrenholdt | 204/225 X |
| 3,361,654 | 1/1968 | Deprez et al. | 204/225 X |
| 3,594,300 | 7/1971 | Schäfer | 204/225 |
| 3,817,846 | 6/1974 | Gebauer et al. | 204/225 X |
| 4,210,513 | 7/1980 | Mutschler et al. | 204/225 |
| 4,448,660 | 5/1984 | Fabian | 204/228 X |

*Primary Examiner*—Donald R. Valentine

*Attorney, Agent, or Firm*—Cooper, Dunham, Griffin & Moran

[57] ABSTRACT

In an aluminium reduction cell, the height of the anodes within the cell are controlled automatically, usually by computer. Means (S1 . . . SN, C1 . . . CN) are provided for making small anode movements in order to effect this automatic control but, for safety reasons, these control movements are limited to a maximum preset duration by timers (T1,T2). These are occasions, however, when longer anode movements need to be undertaken and the present apparatus provides means (6) for overriding these timers during such longer anode movements. Various safety measures are incorporated in this overriding function to ensure that safety requirements are maintained.

6 Claims, 1 Drawing Figure

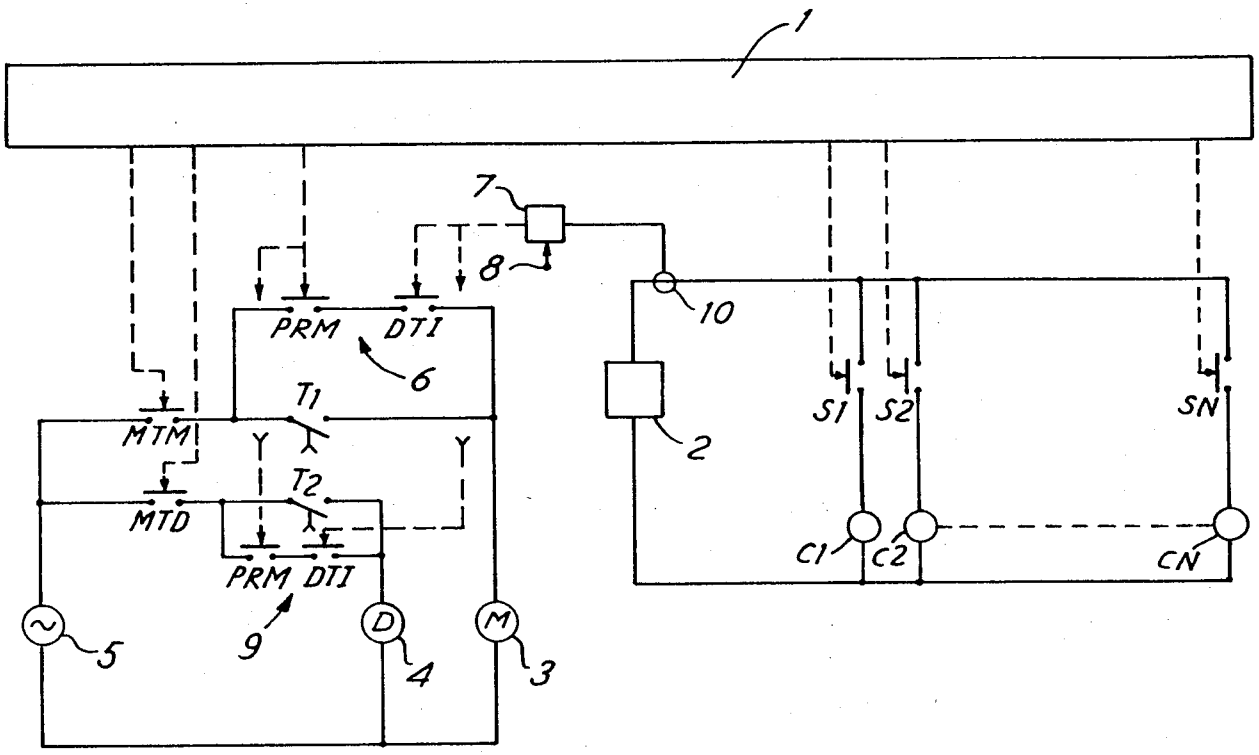
1
SN
CN
S2
C2
S1
C1
10
2
7
8
DTT
6
PRM
T1
T2
DTT
PRM
9
MTM
MTD
3
4
5

APPARATUS AND METHOD FOR CONTROLLING ANODE MOVEMENT IN ALUMINIUM REDUCTION CELLS

This invention relates to apparatus for controlling anode movement in aluminium reduction cells.

A typical reduction cell comprises a layer of molten electrolyte, generally based on cryolite $Na_3AlF_6$, containing dissolved alumina. Carbon anodes are suspended with their lower ends dipping into the cell electrolyte. The floor of the cell is cathodic and may be formed of carbon and/or may include cathode current collectors embedded in the potlining. Upon passage of electric current, molten aluminium metal is formed on the floor of the cell, and may form a layer underlying the electrolyte layer. This molten aluminium layer, which increases in depth as more aluminium is produced, forms the effective cathode of the cell. Oxygen from the alumina reacts with the carbon anodes which are progressively consumed. A protective freeze of solidified electrolyte forms round and over the molten electrolyte layer, and the anodes project through this frozen crust. From time to time fresh alumina, and other ingredients required for cell operation, are added through a hole formed in the frozen crust.

Control of the anode-cathode distance is important if the cell is to function correctly and means are therefore provided for raising and lowering the anodes as conditions in the cell change. Hitherto, all anodes in a cell were attached together on a frame and moved together to effect this control. This has obvious disadvantages, and more recent cells have incorporated the feature of individual anode movement and it is with a cell of this latter type that the present invention is concerned. It is also necessary periodically to remove one or more spent anodes from the cell and replace with fresh anodes.

It is found in practice to be difficult to exactly equalize the movement of the individual anodes and operation of the cell is greatly simplified if all the anodes or a large group of anodes could be raised or lowered together by a substantially equal amount, while at the same time retaining the possibility of raising and lowering the anodes individually for anode changing and like purposes.

The present invention can be applied to any reduction cell equipped with an individual drive to each anode (although, in the present context, the word "anode" should be replaced by "anode rod" where two or more anodes are supported by each rod). There are two main types of such drive, one described in European patent application No. 0086593 in which all or at least some of the anodes are grouped together under the drive power of a single drive motor, with drive to individual anodes by means of respective clutches, and one, for example such as is described in British Pat. No. 602876, in which the drive to each anode rod is powered by its own motor. In both systems anodes may be moved collectively or individually, depending upon the particular requirements. During normal operation of the cell, the individual anode heights are controlled automatically to account for consumption of the anode, cathode height and other factors. The movements undertaken by the anodes are generally small and of short duration. In the event that a large upward anode movement is undertaken, there is the danger that the anode will break contact with the electrolyte and, since the anodes within a cell are connected in parallel, this means that the remaining anodes have to share the current lost to the raised anode. If only one anode is raised, this is not a problem; indeed it is an advantage of the system of individual anode control that a single anode can be raised out of contact with the electrolyte for changing. However where a number of anodes are raised, this can lead to dangerously high currents flowing in the remaining anodes resulting in rapid overheating and disintegration. Furthermore, since the cells are connected in series the raising of all anodes in one cell will result in an open circuit and all of the cells would close down. Likewise, in the event that a large downward anode movement is undertaken, there is a danger that the electrolyte level rises to the point of overflowing out of the cell cavity.

To counteract these problems, timers are fitted to limit the maximum possible duration of upward and downward anode movement during normal cell control to a level (e.g. a few seconds) which is felt to be safe. However, there are circumstances where anode movement has to be in excess of this safe limit. For instance to change an anode or to check the working surface of an anode, it is necessary to effect an upward movement which is considerably in excess of the safe limit typically several minutes. Likewise, downward movement of long duration may have to be effected for instance when a not completely spent anode has been raised, for checking purposes or some other reason, and must be lowered to the working level. It is therefore necessary to have some safe means whereby the timer may be overridden. Otherwise, large upward and downward anode movements have to be realised through a series of short bursts, which would not be proof against computer or electrical equipment malfunction.

In the apparatus of the invention each timer (one for upward movement and one for downward movement) takes the form of a timer switch which controls the electric current to the anode drive, such as a motor. Each timer switch is connected in parallel with a bypass circuit to selectively short out the switch to thus allow current to be supplied to the anode drive for longer upward or downward movement than the preset timer period. In its simplest form, this bypass circuit simply comprises a "large movement" switch which may be closed by an operator when required, for instance, when an anode has to be changed. In practice this would involve putting the associated computer into anode change mode which would have the effect of closing the large movement switch under the direct control of the computer.

In a modified form of the invention each bypass circuit further comprises a current detector switch which is in series with the large movement switch and must therefore be closed as well in order to short out the timer switch. The current detector switch is controlled in such a way that it is closed when only one of the anodes is being moved—i.e. the anode being raised for changing—and is opened if power is supplied to the drive mechanism of any other anode or anodes. This is achieved by detecting the total current supplied to all of the anode drive mechanisms (be these clutches or motors depending upon the anode raising system used) and comparing that with the known current requirement for a single anode drive mechanism. When the total current exceeds that required for just a single anode drive mechanism, the current detector switch opens to halt upward or downward movement of the anode and enable remedial action to be taken.

In order that the invention may be better understood an embodiment thereof will now be described by way of example only and with reference to the accompanying drawing which is a block diagram of a control apparatus according to the invention.

In the drawing, solid lines represent hard-wired connections whilst dotted lines represent control connections.

The drawing shows a circuit for the type of cell in which each of the anodes is individually movable independently of the others. To this end, each anode (not shown) is associated with a respective anode drive mechanism in the form of a clutch C1, C2 . . . CN which selectively transfers drive from a single motor, common to all anodes, to a selected anode or anodes. Each of these clutches is connected in series with a respective electronic switch S1, S2, . . . SN under control from a cell computer 1. All of the series-connected clutch and switch combinations are connected in parallel across a power supply 2 and a current detector 10 monitors the total current supplied to all the clutches. Under normal operation, the computer 1 controls operation of the switches S1, S2, . . . SN to control the upwards and downwards movement of the anodes needed to maintain correct conditions within the cell.

The motor is also under computer control via respective up and down motor contactor coils 3 and 4. Energisation of coil 3 causes the motor to turn in a direction to move the anodes in an upwards direction, energisation of coil 4 in the downwards direction. Power is supplied to the coils from a power supply 5 via various switches as will now be explained.

The motor down contactor coil 4 is connected to the supply via a computer controlled electronic switch MTD and a timer switch T2. Likewise the motor up contactor coil 3 is connected to the supply via a computer controlled electronic switch MTM and a timer switch T1. Only one contactor coil can be energised at a time. The two timer switches are set in such a way that, when their associated switches MTD or MTM are closed under the control of computer 1, they also close, and remain closed for the time switches MTD or MTM are closed up to a predetermined maximum time—e.g. 10 seconds—judged to be the maximum safe period of anode movement under normal computer control. When, however, an anode needs to be fully raised, for instance, to be changed, it is necessary to override timer switch T1 in order to allow the motor up contactor coil 3 to be energised for a sufficiently long time to raise the anode by the distance necessary to allow a change to be effected. This is achieved by a bypass circuit 6 which is operable to selectively short the timer switch T1 allowing power to be supplied to the motor up contactor coil 3 for a period, subject to certain safeguards, which is as long as necessary.

The bypass circuit 6 comprises two electronic switches PRM and DTI connected in series across timer switch T1. When both switches PRM and DTI are closed, the timer T1 is shorted. The switch PRM is under computer control and is energised (i.e. closed) only when the computer is in the appropriate control mode, for instance anode change mode. This control mode is set by the operator when appropriate. The switch PRM is thus known as the large movement switch.

The switch DTI is not under computer control but rather is under the control of a comparator 7. The comparator 7 is operable to compare the total current flowing in the clutch circuit, as detected by the current detector 10, with a predetermined reference current obtained at a terminal 8. The arrangement is such that the switch DTI is closed only when the current detected by detector 10 equals the requirement of just one clutch C1, C2 . . . or CN. This ensures that, during the long upwards anode change movement, only that anode being changed can move; if, due to equipment malfunction or other reason, the computer energises one or more of the clutches other than that of the anode being raised, the switch DTI will open and, provided that the period of timer T1 has expired, the upwards movement will, for the time being at any rate, cease.

The upwards anode change movement can also be halted if at any time the computer mode which allows large movement is cancelled. This causes the switch PRM to open and, provided that the period of timer T1 has expired, this will in turn cause the upwards movement of the anode to cease. Likewise when a long downward movement is needed, it is necessary to override timer switch $T_2$ in order to allow motor down contactor coil 4 to be energised for a sufficiently long time. For this purpose, the system incorporates a further bypass circuit 9 which comprises a replica of the two switches PRM and DTI connected in series across timer switch $T_2$. The operation of the bypass circuit 9 is the same as explained above for bypass circuit 6.

If an anode change movement cannot be completed as a result of the occurrence of one of the conditions described above, the change of anode will not take place until appropriate remedial action is taken.

There now follows a brief resume of a typical sequence of operation, for example, for anode change. It will be understood that, during normal cell operation, (i.e. no anodes being raised) the various anodes can move up and down at will—several at the same time if necessary. At the commencement of an anode change, the operator puts the computer into "anode change" mode which has the effect of closing electronic switches MTM and PRM, together with the appropriate one of the clutch switches S1, S2, . . . SN. Closure of switch MTM causes the timer switch T1 to close and timing commence. If all is well, this causes a current due to the one clutch being energised to flow in the clutch circuit and this causes the switch DTI, via the comparator 7 and current detector 10 to close so that, when the timer switch T1 opens at the end of its period the circuit will be maintained by the switches PRM and DTI. The end of the anode change movement is signalled automatically by the computer which automatically opens switch MTM to halt the anode at an appropriate level so that it can be changed.

Once the anode is changed for a new one, the new anode is moved downwards into position. However, no downward movement of the newly installed anode would need to be longer than the safe limit allowed by the timer T2. Normal cell operation provides for the gradual downward movement of the new anode over a prolonged period, such as 24 hr. to prevent thermal shock which might cause disintegration of a cold anode. The new anode is therefore moved downwards in stages until its normal operating position and temperature are reached.

A secondary function of the current detector 10 is the regular self-checking of the clutch circuit function, by verifying that the appropriate current flows to each clutch. If no current or too much current flows, clutch malfunction will occur which would interfere with the up and down anode movements of normal cell control.

A computer check can be made at regular intervals, say every 24 hours, by cycling through the clutches one by one.

I claim:

1. An anode drive system for an electrolytic reduction cell, said system comprising anode drive means including a plurality of individual anode drive mechanisms, one for each anode, each said anode drive mechanism including gear means for raising and lowering its respective anode; an electric circuit operable to supply power to said anode drive means, said electric circuit including a timer switch which remains closed to supply electric current to the anode drive means only for a preset timer period and a bypass circuit operable to selectively short out the timer switch to allow current to be supplied to the anode drive means for longer than the preset timer period; and means for monitoring the total current supplied to said anode drive mechanisms to produce a control signal; said bypass circuit including a switch means which is controlled by said control signal in such a way as to be closed only when said monitoring means indicates that current is being supplied only to a single one of said anode drive mechanisms.

2. An anode drive system as claimed in claim 1 wherein said bypass circuit includes a large movement switch which may be selectively closed in order to place the system in an appropriate control mode to thus potentially allow shorting of said timer switch.

3. An anode drive system as claimed in claim 1 wherein said switch means and said large movement swtich are connected in series across the timer switch.

4. An anode drive system as claimed in claim 1 wherein each of the anode drive mechanisms further comprises a clutch operable to selectively supply drive to said gear means, and wherein said anode drive means further includes a motor for providing drive to a plurality of or all of said clutches.

5. An anode drive system as claimed in claim 1 wherein each of said anode drive mechanisms further comprises an individual motor operable to supply drive to its respective gear means.

6. A method of controlling anode movement in aluminium reduction cells of the type comprising a plurality of anodes, each having an individual anode drive mechanism for raising or lowering its respective anode and an electric circuit including a timer switch for supplying current for a preset period to an anode drive mechanism, said method comprising monitoring the total current supplied to said anode drive mechanisms during anode movement, comparing the total current with a reference current representative of the current supplied to just a single anode drive mechanism and shorting the timer switch to allow supply of current to the anode drive mechanism for longer than said preset period only in the event that said total current is less than or equal to said reference current.

* * * * *